US005251692A

United States Patent [19]

Haussmann

[11] Patent Number: 5,251,692

[45] Date of Patent: Oct. 12, 1993

[54] FLAT TUBE HEAT EXCHANGER, METHOD OF MAKING THE SAME AND FLAT TUBES FOR THE HEAT EXCHANGER

[75] Inventor: Roland Haussmann, Wiesloch, Fed. Rep. of Germany

[73] Assignee: Thermal-Werke Wärme-, Kälte-, Klimatechnik GmbH, Hockenheim, Fed. Rep. of Germany

[21] Appl. No.: 902,230

[22] Filed: Jun. 22, 1992

[30] Foreign Application Priority Data

Jun. 20, 1991 [DE] Fed. Rep. of Germany ..... 4120442
Jan. 23, 1992 [DE] Fed. Rep. of Germany ..... 4201791

[51] Int. Cl.[5] ..... F28D 1/04

[52] U.S. Cl. ..... 165/152; 165/153; 165/177

[58] Field of Search ..... 165/152, 153, 177

[56] References Cited

U.S. PATENT DOCUMENTS

| | | | |
|---|---|---|---|
| 1,974,595 | 9/1934 | Askin | 165/153 |
| 2,035,403 | 3/1936 | Przyborowski | 165/165 |
| 2,063,757 | 12/1936 | Saunders | 165/153 |
| 2,970,812 | 2/1961 | Kritzer | 165/152 |
| 3,254,400 | 6/1966 | Gordon | 29/413 |
| 3,298,432 | 1/1967 | Przyborowski | 165/153 |
| 4,332,293 | 6/1982 | Hiramatsu | 165/153 |
| 4,766,953 | 8/1988 | Grieb et al. | 165/177 |
| 5,069,277 | 12/1991 | Nakamura et al. | 165/173 |

FOREIGN PATENT DOCUMENTS

| | | | |
|---|---|---|---|
| 0030072 | 6/1981 | European Pat. Off. . | |
| 374896 | 6/1990 | European Pat. Off. . | |
| 0379701 | 8/1990 | European Pat. Off. . | |
| 255313 | 10/1990 | European Pat. Off. . | |
| 1000407 | 6/1957 | Fed. Rep. of Germany . | |
| 3131155 | 2/1983 | Fed. Rep. of Germany . | |
| 3720483 | 1/1988 | Fed. Rep. of Germany . | |
| 3743293 | 6/1989 | Fed. Rep. of Germany . | |
| 9015090 | 2/1991 | Fed. Rep. of Germany . | |
| 362825 | 7/1906 | France | 165/152 |
| 937383 | 8/1948 | France . | |
| 1114983 | 4/1956 | France | 165/152 |
| 542715 | 10/1955 | Italy | 165/152 |
| 243489 | 12/1985 | Japan | 165/152 |
| 1994 | 1/1986 | Japan | 165/177 |
| 469039 | 8/1975 | U.S.S.R. . | |
| 538018 | 7/1941 | United Kingdom . | |
| 633250 | 12/1949 | United Kingdom | 165/153 |
| 723398 | 2/1955 | United Kingdom . | |

*Primary Examiner*—John Rivell
*Assistant Examiner*—L. R. Leo
*Attorney, Agent, or Firm*—Spencer, Frank & Schneider

[57] ABSTRACT

A flat tube heat exchanger includes headers (4) and a number of flat tubes (12) between the headers (4), the flat tubes (12) having flat sides (14) and short sides (50) that are rounded. The flat tubes (12) also have internal reinforcing ribs (42). The heat exchanger also includes zigzag fins disposed between the flat sides (14) of the flat tubes (12), the fins being soldered to the flat tubes. The longitudinal extent (1) of a rounded short side (50) of a flat tube (12) is greater than half the distance d between the flat sides (14) of the flat tube (12). Furthermore, the zigzag fins (16) are soldered to portions (58) of both rounded short sides (50) of the flat tube (12). In the process for producing the flat tube heat exchanger (12), the ends of the flat tubes (12) are inserted into slits (8) of a header (4) and are cut free from their reinforcement ribs (42). The ends of the flat tubes (12) are then expanded against the rims of the slits (8) in the header (4). The heat exchanger can be used as a condenser in a vehicle air conditioner, or as a cooler for an engine or transmission or hydraulic oil in a motor vehicle. Flat tubes for installation in the flat tube heat exchanger can be linked together when they are made to facilitate transportation and handling.

20 Claims, 5 Drawing Sheets

FLAT TUBE HEAT EXCHANGER, METHOD OF MAKING THE SAME AND FLAT TUBES FOR THE HEAT EXCHANGER

CROSS REFERENCE TO RELATED APPLICATION

This application claims the priority of German Application Nos. P 41 20 442.5 filed Jun. 20, 1991 and P 42 01 791.2 filed Jan. 23, 1992, which are incorporated herein by reference.

BACKGROUND OF THE INVENTION

The invention relates to a flat tube heat exchanger of the type having a plurality of flat tubes with flat sides and short sides that are rounded, and having zigzag fins that are internested in a sandwich-like fashion between the flat sides of the flat tubes, the fins having edges that are soldered to the flat sides of the flat tubes. A flat tube heat exchanger of this kind is known from German Patent Document A1-37 20 483 (FIG. 4), for instance. The invention also relates to a process for producing such a flat tube heat exchanger, the use of such a flat tube heat exchanger, and flat tubes for installation in the flat tube heat exchanger of the invention.

In such known flat tube heat exchangers (see also European Patent Disclosure B1-0 255 313, or the present Assignee's European Patent Disclosure A2-0 374 896), the short sides of the flat tubes are rounded with a semicircular arc whose radius equals half the distance d between the flat sides of a flat tube. This is the most frequently used embodiment of the short sides of flat tube heat exchangers, which are produced for various uses on a mass-production scale.

Zigzag fins and fins equivalent to them—hereinafter sometimes called merely fins for short—are internested laterally side by side in sandwiched fashion, in the following order: flat tube—(zigzag) fin—flat tube—(zigzag) fin—etc. This arrangement is not equivalent to inserting tubes into fins (usually provided with collars) in fin packages, where unlike the flat tube heat exchangers of the invention, the fins or their collars annularly surround the applicable tube (see British Patent Disclosure 538,018, for example); this last arrangement is therefore not addressed within the scope of the invention.

It is also known to embody the short sides of the flat tubes rectangularly, with rounded edges, or in gabled form with an obtuse angle at the apex of the gable. In all these cases, the zigzag fins are soldered only to the flat sides of adjacent flat tubes, and there is correspondingly the attempt to select the longest possible extension length of these flat sides. However, it does happen that the fins, soldered only to flat faces, will slip before the soldering. This not only interferes with the appearance of the heat exchange surface; it also increases its actual structural depth, and moreover may even cause problems in the heat-conducting connection between the flat tubes and the fins.

Moreover, the known profiling of the short sides of the flat tubes proves only limitedly streamlined in terms of the external heat exchanger fluid, such as an airflow, that sweeps through the fins.

Finally, when they are disposed in the engine compartment of a motor vehicle, the known profiles of the short sides of the flat tubes are sensitive to being struck by stones.

SUMMARY OF THE INVENTION

It is therefore an object of the invention to improve the quality of connection of the fins to the flat tubes, and in so doing to take external flow dynamics appropriately into account. The flat tube heat exchanger is used in a motor vehicle, another object is to lessen the danger that stones will strike it.

These objects can be attained by providing a flat tube heat exchanger, of the type mentioned above, which is characterized in that the longitudinal extension 1 of the applicable rounded short side of the applicable flat tube is greater than half the distance d between the flat sides of the flat tube, and in that the zigzag gins are also soldered to portions of both rounded short sides of the flat tube.

According to the invention the rounded short sides are provided according to the invention with a more elongated rounding than previously employed, and because of this the $c_W$ value (that is, the coefficient of resistance of the heat exchanger with respect to the flow of the external heat exchange medium) is decreased. The decrease of the $c_W$ value reduces the pressure loss of the external heat exchange medium. Upon installation in motor vehicles, better deflection of stones from outside is also provided, as long as the stones do not directly strike the apex region of the rounded short sides. Moreover, because of the elongated rounded short sides, it is possible not only for the fins to rest on the flat sides of adjacent flat tubes, but also for the flat tubes to wrap form-fittingly around a significant length of the profile, so that the form fit protects against slippage in the longitudinal direction L of the flat tube before soldering is done.

In conventional flat tube heat exchangers of the type to which the invention, relates, the longitudinal length l of the semicircularly rounded short side of the applicable flat tube equals half the distance d between the flat sides of the flat tube. The other known flat tube heat exchangers mentioned have even lower values of l. This is no accident, because the goal previously was to have the longest possible soldering length along the flat sides of the flat tube profile. The invention intentionally departs from this earlier principle of construction of all the known flat tube heat exchangers, to achieve the aforementioned novel effects. Moreover, the soldering length of the fins along the flat tube profile is even increased further, because for the first time, soldering is done even in subregions of the rounded short sides of the flat tube.

The elongated extension l of the rounded short side is preferably greater than the distance d between the flat sides. The effect is that the elongation of the rounded short sides of the flat tubes is even more substantially pronounced.

It is possible to embody the elongatedly rounded short sides of the flat tube with a continuously varying curvature, for instance along an ellipse. However, it is structurally simpler and at the same time entirely adequate for practical requirements to make a combined curvature from circular arcs of different radii. In the limit case, it is entirely adequate to use a first circular arc to form the apex of the rounded short side, and to append to this circular arc a single further circular arc toward both sides of the apex, extending as far as the flat sides. If there are more than two circular arcs of different radii, then the transition from the apex to the flat sides proceeds over a succession of circular arcs each with an increasing radius from the apex to the flat sides.

Purely theoretically, in would be conceivable to solder the fins to the rounded flat sides of the flat tubes up to the apex of the flat tubes and in this sense to provide a 100% wraparound of the flat tubes. For reasons of materials science, however, namely to prevent tearing of fins upon overly great deformation, it is preferable for the zigzag fins to extend freely from the regions soldered to the rounded short sides at least as far as two imaginary planes tangent to the apexes of the rounded short sides. That is, the fins are carried at least up to the apex points of the short sides in the region not soldered to the short sides.

This concept of the free extension of the fins can be still further increased by extending the fins past the imaginary tangential plane at least on one short side of the flat tubes, so that the extended fin regions cover the rounded short sides of the flat tubes at least partially toward the outside. This provides additional protection against damage, for instance from stones in the case of motor vehicles. That is, if the fins, soldered only to the flat sides in the known flat tube heat exchangers, were made to project past the imaginary tangential planes to the apex points of the rounded short sides of the flat tubes, then the result would be rectangularly protruding fin contours that did not cover the rounded short sides of the flat tubes; such protruding fins would be mechanically unstable, because they would protrude freely over a relatively long distance, to the regions where they were soldered to the flat sides of the flat tubes. Since in the arrangement of the invention, soldering is also done with relatively long segments of the rounded short sides of the flat tubes, the free projection distance is comparatively far less, which in turn leads to relatively greater mechanical stability.

If the freely extending region of the zigzag fins follows the last radius of curvature in the region soldered to the rounded short side, the result is an simple way structurally to create the projection with a good degree of coverage, with a structurally already existing radius of curvature. This is not contradicted by the fact that fins which protrude past the imaginary tangential plane on at least one short side of the flat tubes can also be employed with different radii of curvature, even optionally in a linear extension behind the soldered region, depending on how the desired ratios of coverage of the rounded short sides of the flat tubes are selected.

In any case, one can freely select between complete or virtually complete coverage of the rounded short sides of the flat tubes, and central residual gaps.

In flat tube heat exchangers of the structural type to which the invention relates, the problem generally exists that the structural depth of the header, in the flow direction of the external exchange medium, is greater than the length L of the profile of the flat tube. For instance, if in accordance with European Patent Disclosure B1 0 255 313, the header is a round tube in which the flat tubes are inserted into slits and tightly soldered, the additional structural depth in the flow direction of the external heat exchange medium dictated by the header is at least twice the wall thickness of the round tube, plus in practice an installation play that amounts to approximately one further wall thickness. For a structural depth of 16 mm in the region of the fin ribbing of the flat tubes, the minimal depth in the region of the header becomes 19 mm. The structural depth in the region of the header is the definitive dimension upon installation in a motor vehicle, for instance. Generally, the tendency is to keep this installation dimension as small as possible, because on it depends the total length of the motor vehicle, or its engine compartment, including the consumption of material in automobile manufacture itself, which is associated with these problems of length. Saving 3 mm of structural depth in the header region leads to an economy, depending on the vehicle type of 10 to 20 kg of vehicle weight, especially sheet metal.

Even if integral round tubes as in the case of European Patent Disclosure B1 0 255 313 are not used, but instead if the header is assembled from two (or more) parts, comparable problems arise. The header of the present Assignee's German Utility Model G 90 15 090.2, which has already been optimized in this respect, still results in a structural depth excess in the header region, including the installation play, of three to four wall thicknesses of the header.

Both these two types of known header embody the optimum in terms of what was previously considered feasible in terms of economy of structural depth in the header region, for flat tube heat of the type having a plurality of flat sides and short sides that are rounded, and having zigzag fins that are internested in a sandwich-like fashion between the flat sides of the flat tubes, the fins having edges that are soldered to the flat sides of the flat tubes.

The elongated embodiment according to the invention of the rounded short sides of the flat tubes makes it possible, for the ends of the flat tubes, which are inserted into slits of a header of an arbitrary construction, to be tapered to such an extent, by deformation in the longitudinal direction L of the flat tube profile, that the structural depth excess of the header that would otherwise occur can be compensated for at least in part or even entirely and in the limit case a structural depth of the header that is even less than the length L of the flat tube profile is conceivable. The structural depth of the header is preferably no greater than the length of the central region of the flat tubes (that is, inward from the deformed end regions) in the longitudinal direction plus twice the wall thickness of the header.

As materials for the flat tubes, fins and headers, all the metals or metal replacement substances known in this connection are possible. Aluminum or an aluminum alloy is preferred. The header might also be produced from a plastic, if the capability of soldering, or some equivalent, is assured, such as plastic welding in the case of the plastic.

Of particularly great importance from a practical standpoint is the case in which the flat tubes are extruded profiles. Then internal reinforcements, such as the known intermediate ribs, can also be achieved in the course of the extrusion, so that the entire flat tube can be made as a mass-production article in a single operation. It is also known to produce flat tubes in multiple parts, with separate reinforcements inserted between. The flat tubes preferably have a wall thickness that ranges from about 0.2 mm to about 0.6 mm.

Especially for the case where the flat tubes are produced as extruded profiles, but also in general, it is preferable for the flat tubes to have a cross-sectional length L of 12 to 25 mm, preferably 15 to 20 mm, in the region of their ribbing. It is also preferable for both rounded short sides together to contribute 40 to 50% of the cross-sectional length L. It is likewise preferable for the distance d between the flat sides of the applicable flat tube to be 2 to 4 mm. At the apex point of a rounded short side, the internal radius of curvature is preferably at least 0.2 mm and the external radius of curvature is preferably at least 0.6 mm. These dimensions meet optimal conditions in comparison with competing heat exchangers of the currently known prior art.

The free edges of the zigzag fins preferably have a corrugation that protrudes to both sides from what would otherwise be the plane of the zigzag fin. This produces an additional mechanical strengthening, as a supplement to improved soldering to the flat tubes.

It is already known to mechanically expand flat tubes, which have no intermediate reinforcement, after insertion into slits of a header. This is known for flat tubes of the type that are used in low-pressure radiators or heating heat exchangers in motor vehicles. The tightness of the flat tubes with respect to the header and the security of the soldering can be improved as a result.

This option can be adopted to flat tubes of the type according to the invention, which have intermediate reinforcements, in particular crosswise ribs, between their flat sides. The corresponding deformation of the ends of the flat tubes inserted into the slits can in fact be especially well performed with heat exchanges having crosswise ribs that are spaced apart by 1 to 2 d.

The heat exchangers according to the invention, or produced according to the invention, find their primary applications as mass-produced articles. The heat exchangers can be used for instance as radiators or evaporators. Because of the production quantities involved, applications in automobile manufacture are preferred, but uses in other fields, including stationary arrangements, should not be precluded.

The invention also relates to flat tubes for installation in a flat tube heat exchanger according to the invention.

The elongated embodiment of the rounded short sides of the flat tubes of the flat tube heat exchanger of the invention results in relatively constant transitional contours when identical flat tubes are disposed close together.

With an interlinked arrangement of the flat tubes according to the invention, such that the apexes of the rounded short sides of the flat tubes are interlinked by bridges of material when they are made, a number of these tubes can be produced simultaneously, preferably initially with an undefined length. Besides injection molding and casting processes, uniform production by extrusion is possible.

For interlinking the various flat tube elements of initially undefined length—or optionally also those of a defined length, as in the case of production by casting or injection molding—it is adequate if the bridges of material have a thickness of 0.05 to 0.03 mm, preferably 0.15 mm, and/or a length of 0.05 to 0.3 mm, preferably 0.2 mm. This makes it possible, for instance, to temporarily store and optionally transport the interlinked arrangement of flat tubes wound onto a core, because the joint-like connections at the bridges of material between the various flat tubes have great bending flexibility. Interlinked flat tubes can also be rolled up substantially better and in a more space-saving manner than individual flat tubes.

BRIEF DESCRIPTION OF THE DRAWINGS

FIGS. 7*b* and 7*c* show two alternative upsetting or deformation states of the flat tube segment of FIG. 7*a.

DESCRIPTION OF THE PREFERRED EMBODIMENTS

Figure 1:
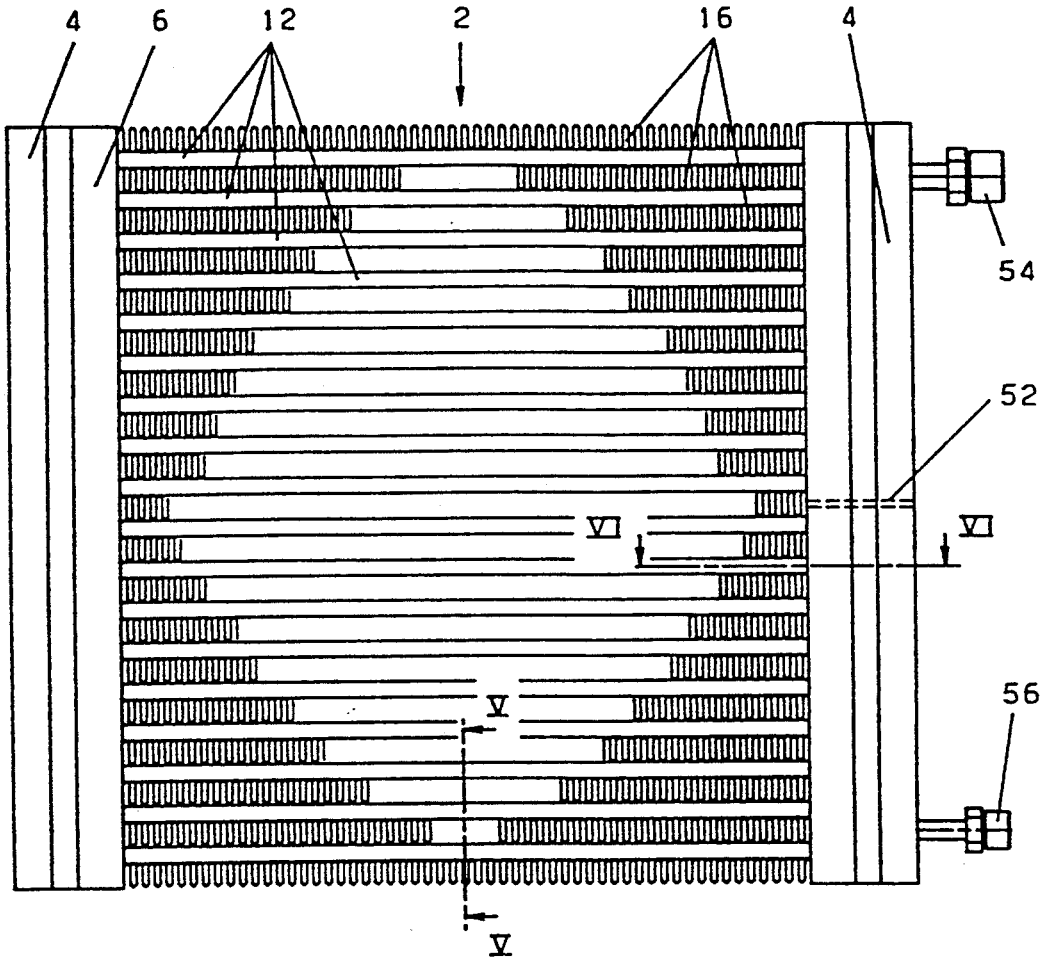
FIG. 1 is a plan view of a flat tube heat exchanger according to the invention, seen in the flow direction of the external heat exchange medium, in particular air.
Figure 2:
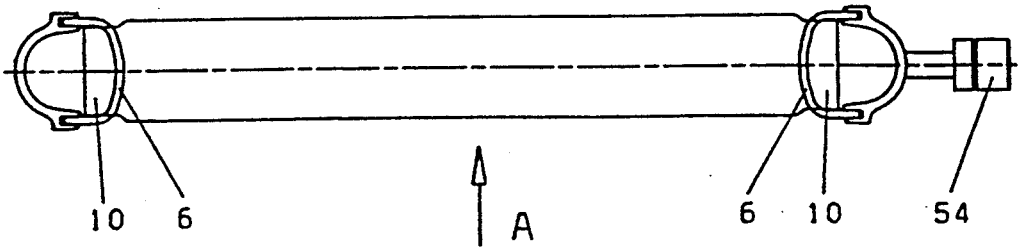
FIG. 2 is a top view of the flat tube heat exchanger of FIG. 1, in the extension direction of the headers.
Figure 3:
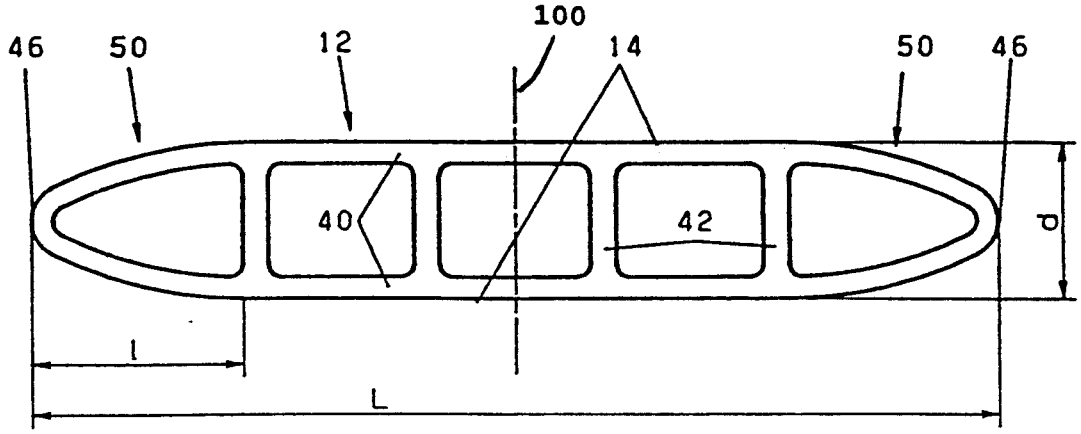
FIG. 3 is a view of the profile of a flat tube as it is used in the embodiment of FIGS. 1 and 2.

The flat tube heat exchanger 2 of FIG. 1 has two parallel headers 4, which without limitation from the standpoint of patent scope have the structure according to German Utility Model G 90 15 090.2. The headers have tube bottoms 6 parallel to one another, which are provided with slits 8 (see FIG. 6) at equidistant intervals, with the slits of the two headers facing one another. These slits 8 are engaged by ends 10 (see FIGS. 2 and 6) of one flat tube 12 each. The flat tubes 12 are soldered or bonded to the headers 4 in a gas-tight and thus liquid-tight manner. As is shown in FIG. 3, the arrangement is made such that the flat sides 14 of the flat tubes 12 are parallel to one another and extend in the longitudinal direction L of the flat tube profile in the flow direction (arrow A in FIG. 2) of the external heat exchange medium. The flat tubes 12 are provided with a heat exchange ribbing in the form of zigzag fins 16, or other fins equivalent to such zigzag fins, in a sandwich-like type of installation in the order of flat tube-fin-flat tube-fin, etc., the fins being soldered or bonded to the flat sides 14 of the flat tubes 12 by their edges 18 (see FIGS. 4 and 5) adjacent to the flat sides 14 of the flat tubes 12.

The circumference of the applicable header 4 is assembled from two structural parts 20 and 22 (see FIG. 6), of which the structural part 20 forms the tube bottom. The tube bottom 20 has the slits 8 for receiving the flat tube ends 10 inserted into them, only one of which can be seen in cross section in FIG. 6. The second structural part 22, together with the first structural part 20, completes the circumference of the header 4. Usually, separate caps (not shown) are placed on the ends of the header 4; however, these caps may also be integrally formed onto one of the structural parts, 20 or 22. Separate caps are appropriately provided, however, if the second structural part 22 is an extruded profile, as is preferred.

The first structural part 20 is suitably coated with hard solder on both sides. The second structural part 22 is suitably embodied as solder-free.

Both structural parts 20 and 22 overlap one another in three layers in two connecting zones 24 extending longitudinally of the header 4; in the overlapping zone in particular, a hard solder connection is present, using the hard solder coating of the first structural part 20.

Figure 6:
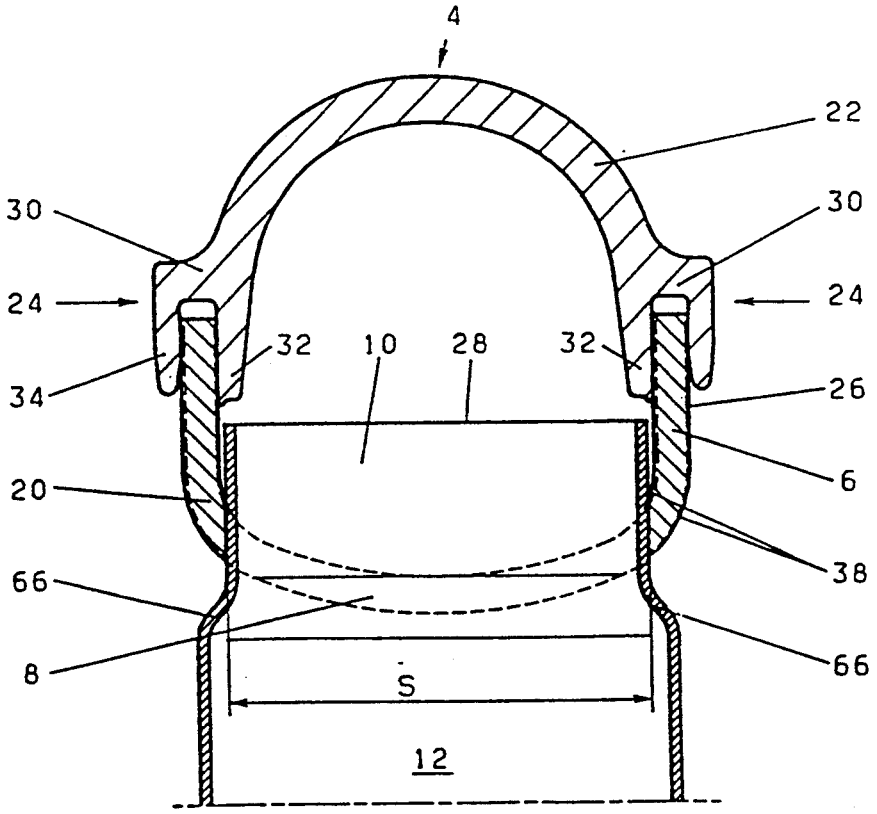
FIG. 6 is an enlarged fragmentary section taken along the line VI—VI of FIG. 1 through a header and an endpiece of a flat tube inserted into the header.

It can be seen from FIG. 6 that the flat tube end 10 is inserted into the header through the applicable insertion slit 8 so far that approximately parallel wall sections 26 still protrude past the inner end 28 of the flat tube 12. The result is that the two connecting zones 24 are also located above the end 28. The wall sections 26 are each grasped by a fork-like formation 30 on the two edges of the second structural part 22 and form the actual connecting zone 24 in the three-layered connection region.

The inner arm 32 of the fork-like formation 30, in this arrangement, is disposed farther inward than the short sides of the mouth or end 28 of the flat tube 12, so that the wall thickness of the inner arm 32 of the fork-like formation 30 contributes nothing further to the structural depth, yet it can be embodied as unweakened with respect to the strength ratios. The outer arm 34 of each fork-like formation 30 can then, as already noted, be embodied with a lesser wall thickness, as also shown in FIG. 6. The outer arm 34 in each case then coheres with the bottom of the fork-like formation 30 via a rated bending line, in the form of a longitudinal groove on the inside of the outer arm 34, on the bottom of the fork-like formation 30, so that the outer arm 34 can be splayed slightly outward. This requires a clamping connection, which is intrinsically sought anyway, between the two arms 32 and 34 of the fork-like formation 30 on the one hand and the wall sections 26 on the other.

The first structural part 20 is advantageously manufactured with its slits 8 as a flat part and provided from the very outset with the solder coating 38 on both sides and only then is made convex. Next, the flat tubes 12 are suitably inserted into the receding slits 8 and mechanically expanded in them. Then, as will be discussed in further detail hereinafter, the second structural part 22 is slipped by its fork-like formations 30 onto the wall sections 26 of the first structural part 20. Finally, the requisite hard solder connections are formed in a soldering furnace, on the one hand in the connecting zones 24 and on the other between the flat tubes 12 and the receiving slits 8.

One header 4 is provided with at least one partition (see FIG. 1), and it is provided with an inlet 54 on one side of the partition and an outlet 56 on the other side of the partition for an internal heat exchange medium. If the other header is then embodied without such a partition, the internal heat exchange medium flows from the inlet 54 through the connected part of the header and the flat tubes 12 connected to it to the opposite header, and then back through the other flat tubes 12 to the other compartment of the first header, and via that header out of the outlet 56. In a known modification, the first header may also be provided with more than one partition and the other header may then likewise be provided with at least one partition, in general a number of partitions that is less by one, so that the internal heat exchange medium is sent back and forth between the headers multiple times through smaller groups of flat tubes. Finally, if an adequate number of partitions is used in one header, the header is provided with the inlet 54 and outlet 56, then it is possible to dispense with the second header entirely and optionally replace it with hairpin turns.

Figure 4:
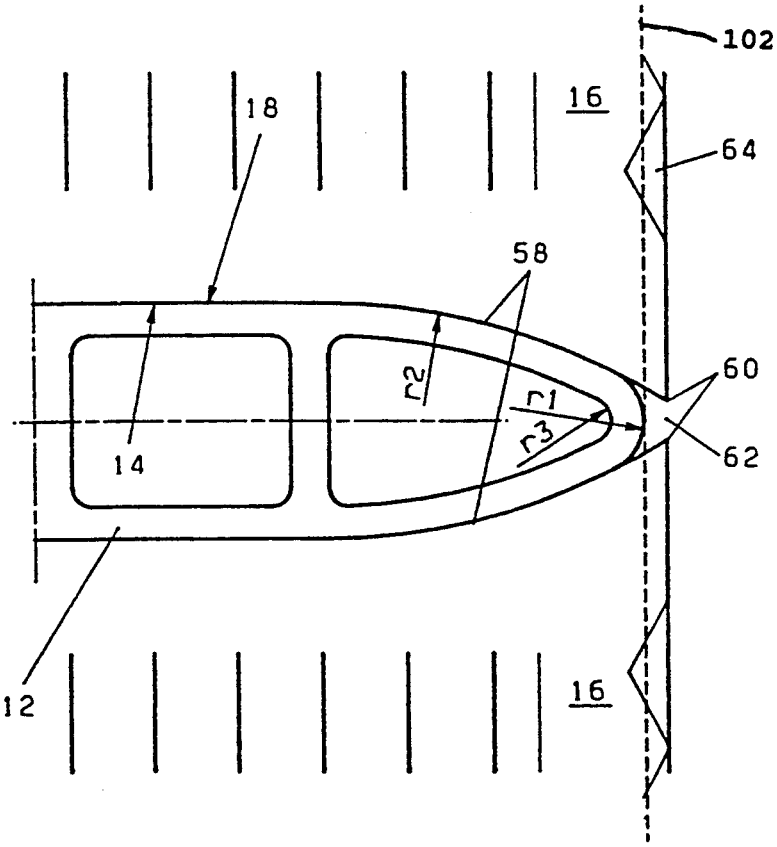
FIG. 4 shows on a larger scale, a fragmentary view of FIG. 3 with a soldered-on fin.
Figure 5:
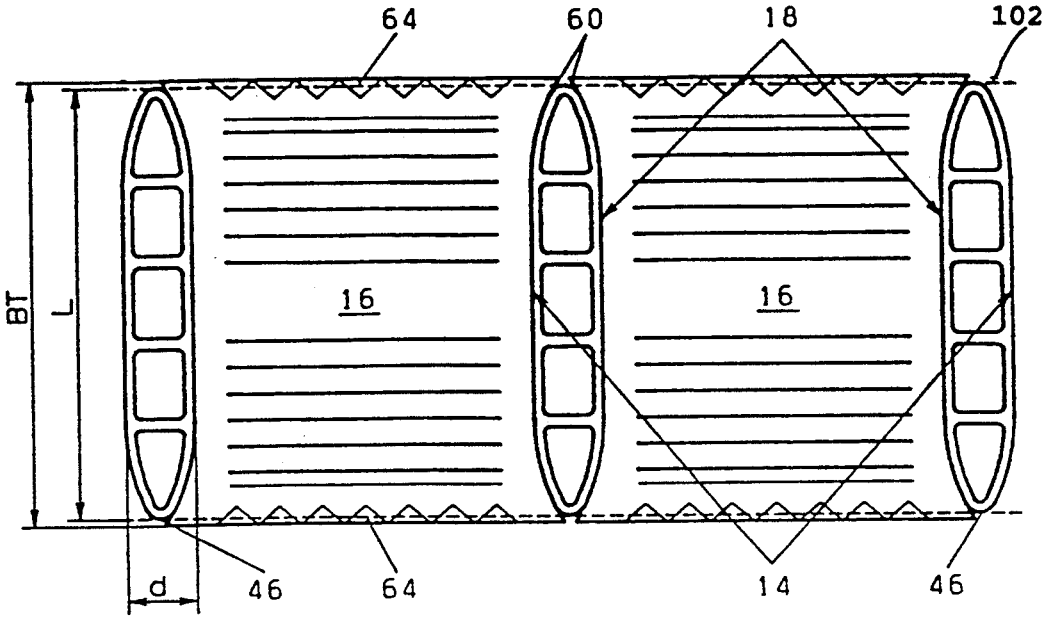
FIG. 5 is an enlarged fragmentary section taken a long the line V—V of FIG. 1.

The profile of the flat tubes 12 can be seen from FIG. 3, in combination with FIGS. 4 and 5.

In the sectional plane of FIG. 3, the profile has a profile length L. The profile is embodied in mirror reversal to the imaginary longitudinal center plane 100, to both sides of which parallel profile walls 40 extend that on the outside form the two flat sides 14 that are parallel to one another. The parallel walls 40 are reinforced against one another by intermediate ribs 42 at right angles to them; a total of four equidistant intermediate ribs are provided here, but without restricting the patent scope. Adjacent ribs 42 are preferably spaced apart from one another by a distance ranging from about one to about two times the distance d between the outer surfaces of the flat tube 12. The parallel walls 40 continue in the form of rounded walls 44, which terminate at an apex 46 of the profile and together produce rounded short sides 50 of the profile. The longitudinal length of one of these rounded short sides in the direction of the dimension L has the dimension l in each case. In the exemplary embodiment of FIG. 3, the rounded short sides 50 adjoin the outermost intermediate rib 42. This is the result here of the construction of the region of the apex 46 with an outer circular arc having the radius R1 (see FIG. 4), and circular arcs having an external radius r2 adjoining both sides of the apex, this region entering the flat sides 14 at a tangent. With this construction, an inner radius r3 results, which in the case of extruded flat tubes is selected to be no less than 0.2 mm, for practical manufacturing reasons. Over the wall thickness, the result radius r1 is r3 plus the wall thickness, so that here r1=0.6 mm (the wall thickness of the flat tube is 0.4 mm), while r2 is selected to be equal to 7 mm.

The illustration of FIG. 3 is to scale approximately at a ratio of 1:8.

As particularly clearly seen from FIG. 4, the fins 16 are soldered not only to the flat sides 14 of the flat tubes 12 but also to the regions 58 of the rounded short sides, specifically in the case of the construction selected in FIG. 4, comprising two circular arcs r1 and r2, along the entire length of the two circular arcs of radius r2. The thickness of the fins 16 preferably ranges from about 0.12 mm to about 0.2 mm.

In FIGS. 4 and 5, the dashed lines represent an imaginary tangential plane 102 to the apexes 46, located next to one another, of adjacent flat tubes 12. It can also be seen from FIG. 4 that the fins 16 extend freely onward to both sides of the rounded short side 50 in the vicinity of the circular arc of radius r1, by the radius r2, specifically not merely as far as the tangential plane 102 but even past it. Between them, the edges 60 of the fins 16 that are rectilinearly aligned with one another on the face ends of the heat exchanger then form only a small gap 62 opposite the apex 46 of the flat tube.

Adjoining the edges 60, the fin 16 is provided with serrations or corrugation 64, which protrude to both sides compared with the otherwise essentially flat plane of the fin and reinforces the region of the fin that protrudes freely from the flat tubes. This region is relatively small in any case, because after all, according to FIG. 4, the fin is soldered up to near its apex 46, or in other words in the region of its entire circular arc having the radius r2.

In FIG. 6, the length S of the applicable slit 8 in the header 4 is smaller than the length L of the profile in FIG. 3 of the flat tube in the region of the ribbing with the fins 16. Nevertheless, the ends 10 of the flat tubes can be inserted into the slits 8, because they are retracted compared with the remaining profile of the flat tubes 12 as shown in FIG. 3. The ends 10 of the flat tubes 12 then change into the normal profile of the flat tubes as shown in FIG. 3, via a transition zone 66 located outside the header.

The possibility of retracting the ends 10 of the flat tubes is based on the selected shape of the rounded short sides 50 of the flat tube profiles. If these sides are upset or deformed longitudinally of their profile cross section as shown in FIG. 7*b* or FIG. 7*c*—which from the standpoint of practical feasibility is only possible because of the relatively elongated shape of the rounded short sides 50 of the profiles—then the tube ends 10 are given a reduced effective length, which enables insertion into the slits 8.

Figure 7C:
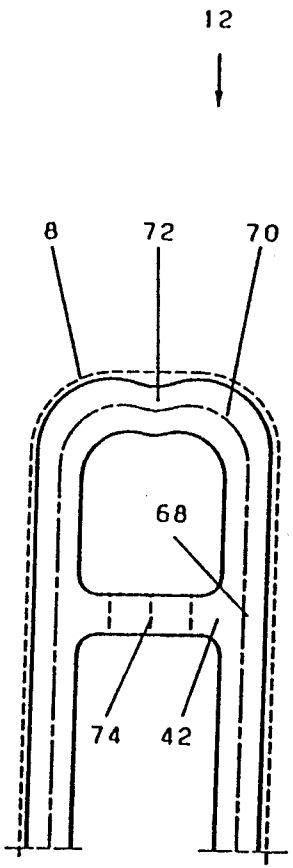
Figure 7B:
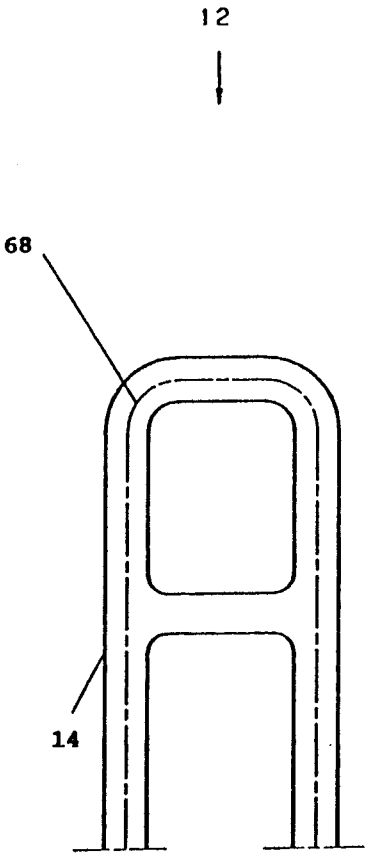
Figure 7A:
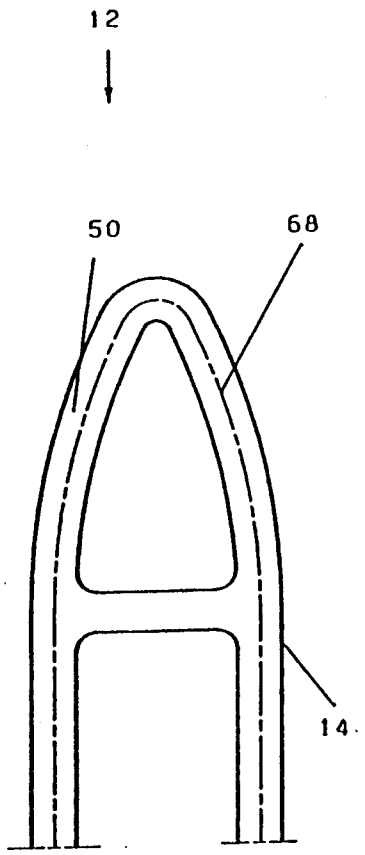
FIG. 7*a* is an enlarged view of a profile segment of a flat tube, including one rounded short side.

FIGS. 7*b* and 7*c* show two preferred options of this longitudinal or deformed of the profiles. In FIG. 7*b*, the deformation is effected, on the rounded short sides 50 in the longitudinal direction of the flat tube profiles, with the length of the neutral grain 68 (shown in dot-dash lines) maintained. In FIG. 7*c*, by comparison, the deformation, takes place at the rounded short sides 50 in the longitudinal direction of the flat tube profiles with simultaneous upsetting of the wall thickness of the material, so that the neutral grain shown in dot-dashed lines is shortened. An accumulation of material can be seen, particularly in the corner regions of the face ends of the upset profile, as represented by reference numeral 70 on one corner, for example. This type of upsetting can proceed so far that a central crease 72 forms in the apex region of the upset rounded portion 50. If the next intermediate rib 42 in order is then cut free, as represented in FIG. 7*c* by the notch 74 shown in dashed lines, then the end 10 of the flat tube engaging the slit 8 can be expanded by an expanding mandrel toward the edge of the slit 8 shown in dashed lines in FIG. 7*c*, and the crease 72 initiated formed can then be stretched further and made to rest straight against the short side of the rim of the slit. The length of the crease first formed can be made useful in order, during the expansion, to fill up the otherwise especially critical corner regions of the slit. The prerequisite for this type of expansion technique is a two-piece embodiment of the header from the two structural parts 20 and 22; the cap-like structural part 22 is then mounted after the expansion on the structural part 20 that forms the tube bottom.

In the outer region as well, the short side of the flat tube is critical to the quality of the soldering. The transition region 66 into the retracted end 10 forms a relatively acute angle with the tube bottom 20, and this angle is especially well-suited for holding solder. The transition region 66 can also serve as a tolerance-compensating stop for form-fitting introduction of the tube ends 10 into the slit 8 of the header 4.

Figure 8:
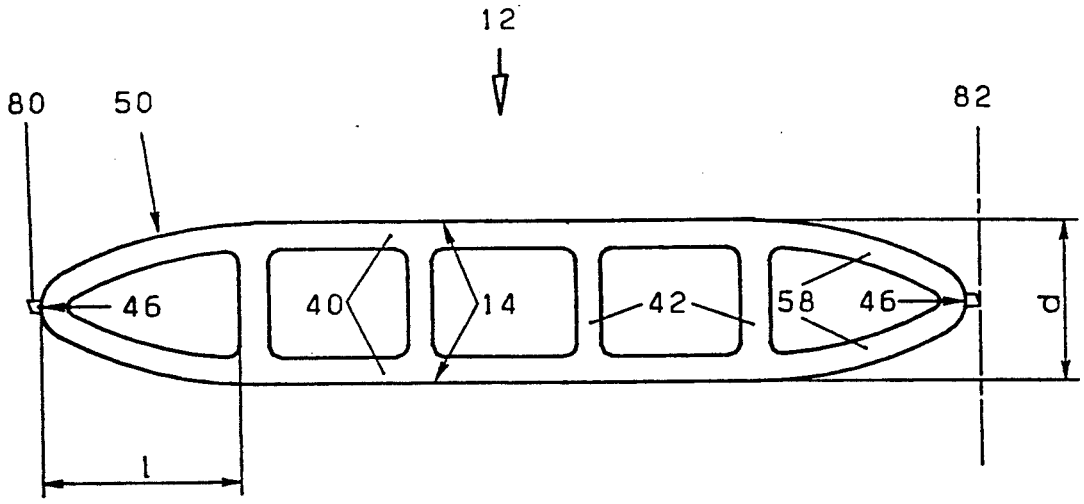
* and FIG. 8 is a cross section through an isolated member of an interlinked arrangement of flat tubes.

In FIG. 8, a plurality of flat tubes 12 are first disposed side by side in one plane, for instance during extrusion, and are interlinked to one another at the apexes 46 of their rounded short sides 50, in each case by a bridge 80 of material, of which FIG. 8 shows only the bridge residues remaining after the bridges have been severed to separate the flat tubes. The applicable material bridge 80 has a low material thickness and a short length in the plane of extension of the flat tubes 12. Aside from the desired function of the interlinked arrangement of flat tubes 12, the dimensions have been selected such that the entire interlinked arrangement can be produced as an integral extruded profile of undefined length. This pertains especially to the minimum dimensions of the material bridge 80. The maximum thickness of the material bridge 80 is selected such that tearing, pushing apart, shearing off, cutting off or a similar known separating process can take place at the parting line. Functionally, in terms of the dimensioning, the following should also be taken into account:

First, the interlinked arrangement of flat tubes 12 should be capable of being wound on a core, initially in a still undefined length, as an integral extruded part, so that it can be temporarily stored and optionally transported.

Second, as shown, only small residues of material should remain from the bridges 80, if a pair of adjacent flat tubes 12 are each cut apart from one another along a single parting line 82.

Reference numeral 58 also indicates those portions at which, in the flat tube heat exchanger of the invention, the soldering to the fins, not shown, of the flat tube heat exchanger, also not shown, takes place. The longitudinal extension l of the applicable rounded short side 50 of the applicable flat tube 12, and the distance d between the flat sides 14 and the applicable flat tube 12 also match the indications given in the description of the flat tube heat exchanger according to the invention. The direction in which the material bridges 80 extend should be understood logically to be the same as that of the longitudinal extension l.

I claim:

1. A flat tube heat exchanger, comprising:

a plurality of flat tubes, each flat tube having a pair of flat sides and a pair of rounded short sides which connect the flat sides, each flat tube extending in a longitudinal direction when seen in a perpendicular cross-section, each rounded short side of a flat tube extending a longitudinal extension distance in the longitudinal direction of the respective flat tube, the longitudinal extension distance being greater than half the distance between the outer surfaces of the flat sides of the respective flat tube; and zigzag fins internested in a sandwich-like fashion between the flat tubes, each zigzag fin being bonded to a flat side of at least one flat tube and to portions of both rounded short sides of the respective at least one flat tube, wherein each rounded short side has an apex with an internal radius of at least 0.2 mm and an external radius of at least 0.6 mm.

2. The heat exchanger of claim 1, wherein the longitudinal extension distance of a rounded short side is greater than the distance between the outer surfaces of the flat sides of the respective flat tube.

3. The heat exchanger of claim 1, wherein each rounded short side is composed of circular arcs of varying radius, the circular arc of minimum radius forming the apex and at least one circular arc of larger radius adjoining the apex on both sides.

4. The heat exchanger of claim 1, wherein the flat tubes are disposed so that each flat tube has a rounded short side whose apex is tangent to a plane, and wherein the zigzag fins have freely extending portions which are not bonded to the rounded short sides and which project at least as far as the plane.

5. The heat exchanger of claim 4, wherein the freely extending portions project beyond the plane.

6. The heat exchanger of claim 1, wherein the fins are curved to follow the rounded short sides where the fins are bonded to the rounded short sides.

7. The heat exchanger of claim 1, wherein the flat tubes have central regions and deformed end regions, the zigzag fins being soldered to the central regions of the flat tubes, wherein the central region of each flat tube has a length in the longitudinal direction and the end region of the flat tube has a length in the longitudinal direction that is shorter than the length of the central portion in the longitudinal direction, and further comprising a header having slits into which the end regions of the flat tubes are inserted and soldered, the slits having a slit length that is shorter than the length of the central portions of the flat tubes in the longitudinal direction.

8. The heat exchanger of claim 7, wherein the rounded short sides of the flat tubes are deformed at the end regions of the flat tubes, and wherein the rounded short sides of each flat tube have the same wall thickness at the end region and the central region.

9. The heat exchanger of claim 7, wherein the rounded short sides of the flat tubes are deformed at the end regions of the flat tubes, and wherein the rounded short sides of each flat tube have a greater wall thickness at the end region than at the central region.

10. The heat exchanger of claim 7, wherein the heat exchanger exchanges heat with an external heat exchange medium which flows across the heat exchanger in a flow direction that is parallel to the longitudinal direction of the flat tubes, wherein the header has a wall, and wherein the header has a structural depth in the flow direction of the external heat exchanger medium, the structural depth of the header being no greater than the length of the central region of the flat tubes in the longitudinal direction plus twice the wall thickness of the header.

11. The header of claim 7, wherein at least one of the header, the flat tubes, and the zigzag fins are made of a metal that comprises the element aluminum.

12. The header of claim 7, wherein the length of the central region of the flat tubes ranges from about 15 mm to about 20 mm.

13. The heat exchanger of claim 1, wherein the flat tubes are extruded members.

14. The heat exchanger of claim 1, wherein the flat tubes have a wall thickness that ranges from about 0.2 mm to about 0.6 mm.

15. The header of claim 1, wherein each flat tube has a length in the longitudinal direction, the pair of rounded short sides contributing about 40% to about 50% of the length.

16. The header of claim 1, wherein the distance between the outer surfaces of the flat sides of the flat tubes ranges from about 2 mm to about 4 mm.

17. The header of claim 1, wherein the zigzag fins have a thickness ranging from about 0.12 mm to about 0.2 mm.

18. The heat exchanger of claim 1, wherein the zigzag fins have free edges that are serrated.

19. The heat exchanger of claim 1, wherein each flat tube has internal reinforcing means between its flat sides.

20. The heat exchanger of claim 19, wherein the internal reinforcing means comprises a plurality of crosswise ribs connecting the flat sides, adjacent ribs being spaced apart from one another by a distance ranging from about one to about two times the distance between the outer surfaces of the respective flat tube.

* * * * *